US005880646A

United States Patent [19]

Vannatta et al.

[11] Patent Number: 5,880,646

[45] Date of Patent: Mar. 9, 1999

[54] COMPACT BALUN NETWORK OF DOUBLED-BACK SECTIONS

[75] Inventors: Louis Jay Vannatta, Crystal Lake; Hugh Kennedy Smith, Palatine; David Ryan Haub, Grayslake, all of Ill.

[73] Assignee: Motorola, Inc., Schaumburg, Ill.

[21] Appl. No.: 852,766

[22] Filed: May 7, 1997

[51] Int. Cl.[6] ..... H01P 5/10; H01Q 9/16

[52] U.S. Cl. ..... 333/26; 333/238; 343/821; 343/895

[58] Field of Search ..... 333/25, 26, 238; 343/859, 821, 895

[56] References Cited

U.S. PATENT DOCUMENTS

| | | | |
|---|---|---|---|
| 2,110,278 | 3/1938 | Shaw | 353/859 |
| 3,614,676 | 10/1971 | Boelke | 333/26 |
| 3,845,490 | 10/1974 | Manwarren et al. | 333/26 X |
| 4,125,810 | 11/1978 | Pavio | 325/446 |
| 4,431,977 | 2/1984 | Sokola et al. | 333/206 |
| 4,460,877 | 7/1984 | Sterns | 333/26 |
| 4,717,896 | 1/1988 | Graham | 333/25 |
| 4,739,289 | 4/1988 | Cripps | 333/26 |
| 4,800,344 | 1/1989 | Graham | 333/25 |
| 4,825,220 | 4/1989 | Edward et al. | 343/821 X |
| 5,014,346 | 5/1991 | Phillips et al. | 455/89 |
| 5,172,082 | 12/1992 | Livingston et al. | 333/26 |
| 5,202,654 | 4/1993 | Heine | 333/206 |
| 5,532,708 | 7/1996 | Krenz et al. | 343/821 X |
| 5,628,057 | 5/1997 | Phillips et al. | 333/26 X |
| 5,697,088 | 12/1997 | Gu | 333/26 X |
| 5,705,960 | 1/1998 | Izumiyama | 333/26 |

FOREIGN PATENT DOCUMENTS

| | | |
|---|---|---|
| 56-148405A | 8/1984 | Japan . |

*Primary Examiner*—Seungsook Ham
*Attorney, Agent, or Firm*—Daniel W. Juffernbruch

[57] ABSTRACT

A balun network is provided having first and second conductor portions symmetric along a center line therebetween. A connecting conductor portion 130 couples ends of the first and second conductor portions with a spacing therebetween. The first and second conductor portions have a like-length of one-quarter wavelength. A balanced port 140 is provided between a first end of the first conductor portion 110 and a first end of the second conductor portion 120. An unbalanced port 150 is provided between a ground reference plane 160 and a first end of the first conductor portion.

18 Claims, 4 Drawing Sheets

COMPACT BALUN NETWORK OF DOUBLED-BACK SECTIONS

BACKGROUND OF THE INVENTION

1. Technical Field of the Invention

The present invention relates to balun networks and, more particularly, relates to a compact balun network having doubled-back sections.

2. Discretion of the Related Art

A balanced-unbalanced network, or balun network, typically has a transmission line of one form or another occupying physical space. As electronic devices become smaller in size, compact balun structures are desired.

Balun networks connect between an unbalanced port and a balanced port to couple balanced and unbalanced transmission lines. A 50 Ohm coaxial cable is an example of an unbalanced transmission line and a 300 Ohm twin-lead wire is an example of a balanced transmission line. Transmission lines are used internal to radios, on printed circuit boards, and in series with the inputs and outputs of components. A more compact balun structure is desired, particularly for use in a portable radio.

DETAILED DESCRIPTION OF THE PREFERRED EMBODIMENTS

Figure 1:
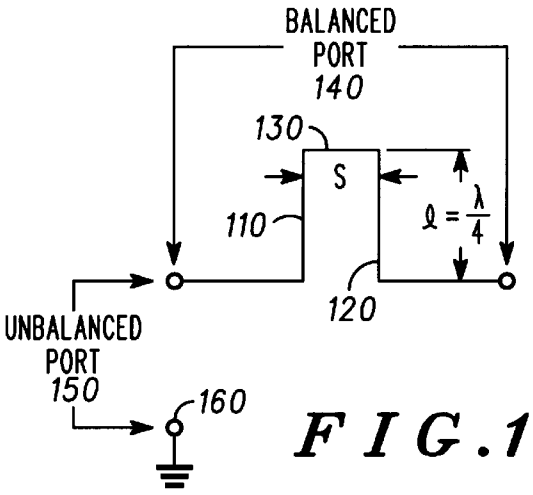
FIG. 1 illustrates a schematic diagram of the balun network.

FIG. 1 illustrates a schematic diagram of a balun network having a first conductor portion 110, a second conductor portion 120 and a third conductor portion 130, connected therebetween. The first and second conductor portions 110 and 120 have the same length I of about one-quarter a wavelength of a nominal frequency of interest. The length can be any odd multiple of about one-quarter a wavelength of the nominal frequency of interest. The first and second conductor portions 110 and 120 have the same length and a space s therebetween.

This spacing s is the about the same as the length of the connecting conductor 130. The spacing s needs to be a distance that provides for electromagnetic coupling between the first conductor portion 110 and the second conductor portion 120 so that the even mode is excited, thereby causing the first and second portions to form a balanced transmission line internal to the balun. The spacing s also has a dimension chosen based on a cross-section dimension of the first and second conductor portions, a dielectric property between the first and second conductor portions, impedances of the balanced and unbalanced ports, and a fractional bandwidth for the balun. By fractional bandwidth we mean the width of the band at a particular center frequency. Thus, the spacing does not move the center frequency; but, rather, moves the width of the band about that center frequency. The lengths of the first and second conductor portions do not affect the fractional bandwidth of the balun, theoretically speaking.

However, the lengths 1 as discussed above do affect the center frequency.

A balanced port 140 is connected between a first end of the first conductor portion 110 and a first end of the second conductor portion 120. An unbalanced port 150 is connected between the first end of the first conductor portion 110 and a ground reference plane or ground 160 of an unbalanced transmission line connected to the unbalanced port.

Figure 3:
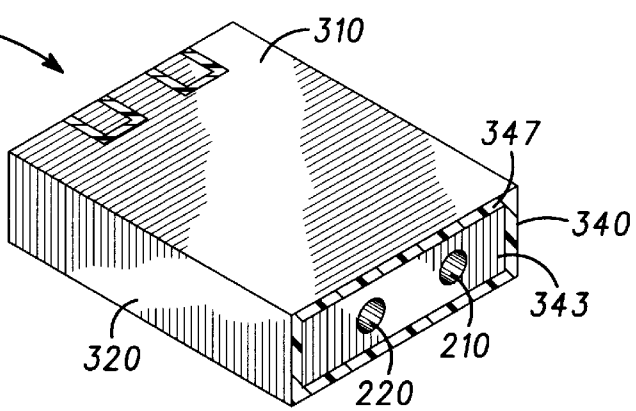
FIGS. 2 and 3 illustrate isometric views of a first embodiment.
Figure 2:
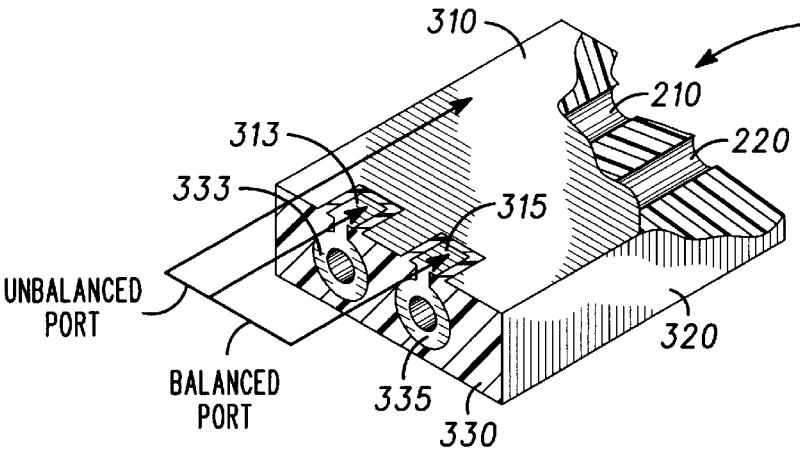

FIGS. 2 and 3 illustrate respective left, top and front side views and right, top and front side views of a first embodiment using a metalized dielectric block. In FIGS. 2 and 3, top surface 310, front surface 320 and back and bottom surfaces of the dielectric block (not illustrated) are metalized. Through holes 210 and 220 are also metalized. The top surface 310 has a portion of metalization removed to provide for metalized pads 313 and 315. The left surface 330 of the dielectric block is metalized in regions 333 and 335 to respectively provide electrical connections from pads 313 and 315 to a corresponding through hole 210 or 220. On the right side 340 of the dielectric block, a center metalization region 343 is metalized, while a perimeter region 347 is not metalized. The perimeter region 347 provides insulation from the adjacent metalized top, bottom, front and back sides of the dielectric block. The center metalization region 343 provides electrical connection between the through holes 210 and 220. The electrical schematic of FIG. 1 is thereby realized by the structure of the selected metalized dielectric block of FIGS. 2 and 3.

The metalization in FIGS. 2 and 3, the through holes 210 and 220 are metalized by one of plating, filling the through holes with metal or solder, or printing a metal solution and firing. Further the surfaces of the dielectric block in the embodiment of FIGS. 2 and 3 are also metalized by plating or printing a metal solution on the surfaces and firing. The spacing s between the first and second lines of the two through holes 210 and 220 can be altered to provide a desired, pre-determined fractional bandwidth of the balun.

Figure 4:
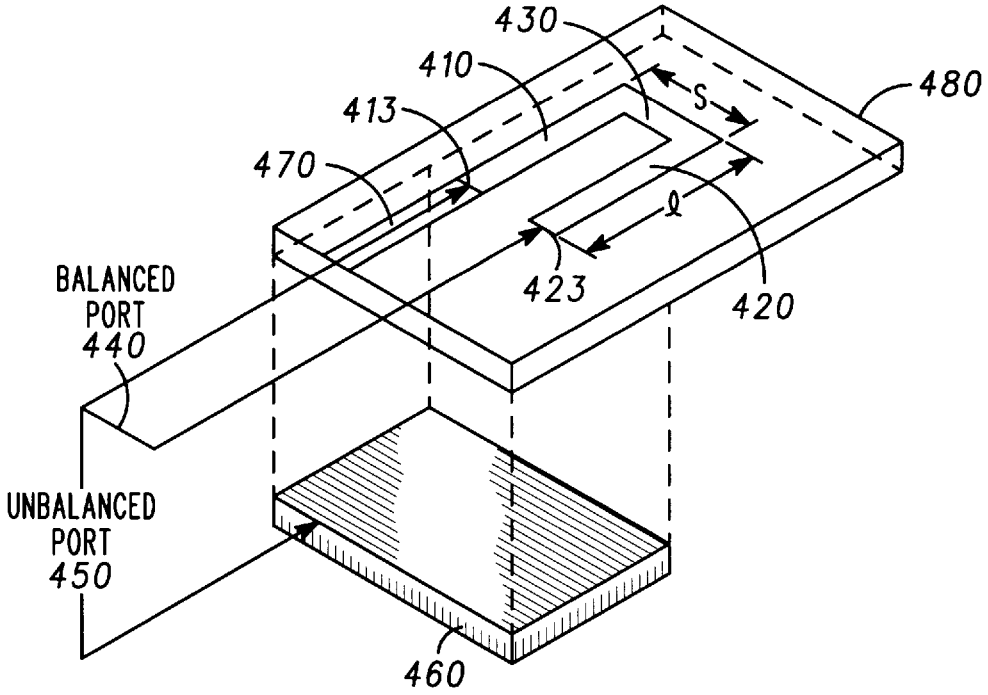
FIG. 4 illustrates an exploded isometric view of a second embodiment.

FIG. 4 illustrates an exploded perspective view of a second embodiment using elongated metal strips on dielectric substrates. A first elongated metallic strip 410 and a second elongated metallic strip 420 are connected by a connecting portion of a elongated metallic strip 430. The first and second elongated metallic strips 410 and 420 have a length of an odd integral multiple of a quarter of wavelength of a nominal frequency of interest. The first and second elongated metallic strips 410 and 420 are spaced a distance therebetween, parallel to one another. The space is equal to the size of the connecting elongated metallic strip portion 430. Because the first and second elongated metallic strip portions 410 and 420 are parallel to one another, they are also symmetric along a center line therebetween. A balanced port 440 connects between a first end 413 of the first elongated metallic strip 410 and a first end 423 of the second elongated metallic strip 420. An unbalanced port connects between the first end 413 of the first elongated metallic strip 410 and a ground reference plane 460. The ground reference plane 460 in the exemplary embodiment of FIG. 4 extends beneath a feed line 470 but does not extend beneath the first and second elongated metallic strips 410 and 420 or the connecting elongated metallic strip portion 430. Although the metal portion does not extend beneath the strips 410, 420, and 430, it alternatively can if additional isolation is necessary for other shielding of nearby components. A dielectric material 480 such as that of a printed circuit board provides a surface for the metal layer 460 and the elongated metallic strips 410, 420, 430, and 470. The balun network of the present invention can thus be realized in a compact structure such as that of FIGS. 2, 3, or 4. The like strips 410 and 420 and strip 430 provide an example of a switchback shape. By doubling back the first and second conductor portions 410 and 420 about connecting portion 430, for example, less linear space is consumed by the balun network.

Figure 5:
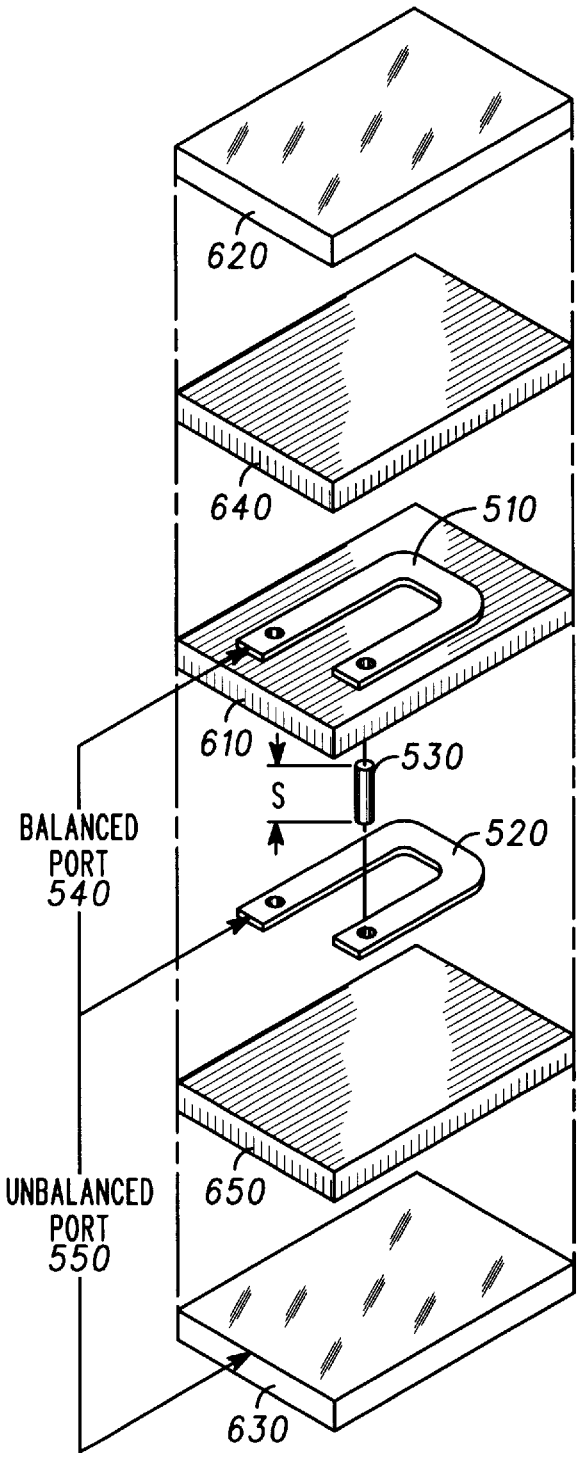
FIG. 5 illustrates an exploded isometric view of a third embodiment.

FIG. 5 illustrates a further, more compact structure for the balun network in the illustrated multi-layer exploded view. In the third embodiment of FIG. 5, the elongated metallic strip of the first conductor portion is no longer coplanar with the elongated metallic strip of the second conductor portion as was the case in the second embodiment of FIG. 4. In the third embodiment of FIG. 5, a first elongated metallic strip conductor portion 510 is placed on a different layer than a second elongated metallic strip conductor portion 520 utilizing a dielectric material 610 therebetween. A metalized through hole or pin 530 provides for a connecting conductor portion therebetween. Thus, the embodiment of FIG. 5 actually doubles back in two ways and is even more compact. First, the first and second conductor portions double back by operation of the metalized through hole or pin 530. Second, each of the two first and second conductor portions 510 and 520 also double back. Such additional doubling back provides for a further compact balun structure easily implementable on a multi-layer printed circuit board.

The spacing s between the first and second conductor portions 510 and 520 again can be altered to provide a pre-determined desired fractional bandwidth for the balun network. Further, the length of each of the first and second elongated metallic strip conductor portions 510 and 520 should be the same and an odd integral multiple of one-quarter the wavelength of a nominal frequency of interest. Also, the first and second elongated metallic strip conductor portions 510 and 520, even though doubling back a second time, are still symmetric along a center line therebetween. In this third embodiment, the center line runs through the dielectric material 610 rather than between the strips on the dielectric material 480 as in the second embodiment of FIG. 4.

The first elongated metallic conductor portion 510 and the second elongated metallic conductor portion 520 are preferably placed on the dielectric substrate 610 such as a printed circuit board. Additional metal layers 620 and 630 can be placed above and below the first and second elongated metallic strip conductor portions 510 and 520 should shielding and isolation from other components on the printed circuit board be necessary. An additional dielectric layer 640 is placed underneath metal layer 620 to insulate metal layer 620 from the elongated metallic strip 510 and a further dielectric layer 650 is placed above the metal layer 630 to insulate the metal layer 630 from the elongated metallic strip 520.

A balanced port 540 is provided between a first end of the elongated metallic conductor portion 510 and a first end of the elongated metallic conductor portion 520. An unbalanced port 550 is provided between a first end of the second elongated metallic conductor portion 520 and a ground plane, such as the metalization 630. However the ground plane could alternatively be provided by the metal 620 or other ground plane having the same electrical potential as the ground plane of an unbalanced transmission line connected to the unbalanced port. Further, either the first end of the first conductor portion 510 or the first end of the second connector portion 520 can be used to provide the other connection to the unbalanced port 550. Since the first and second conductor portions of the balun are the same and symmetric about the center line, there is no electrical difference between the two.

In an alternative to the embodiments in the present invention, as illustrated in the exemplary embodiment of FIG. 5, the widths of the first and second elongated metallic conductor portions 510 and 520 do not need to be identical. By providing different widths for the elongated metallic conductor portions 510 and 520 each of the portions 510 and 520 have different impedances with respect to metal layers 620 or 630. It has been discovered that by providing different impedances into transmission lines, balance for at least current is achieved, while flexibility is provided in the design of the impedances at the ports of the balun. The different impedances of the first and second elongated metallic conductor portions 510 and 520 provide for a selective impedance ratio between the impedance of the balanced port 540 and the impedance of the unbalanced port 550.

Figure 6:
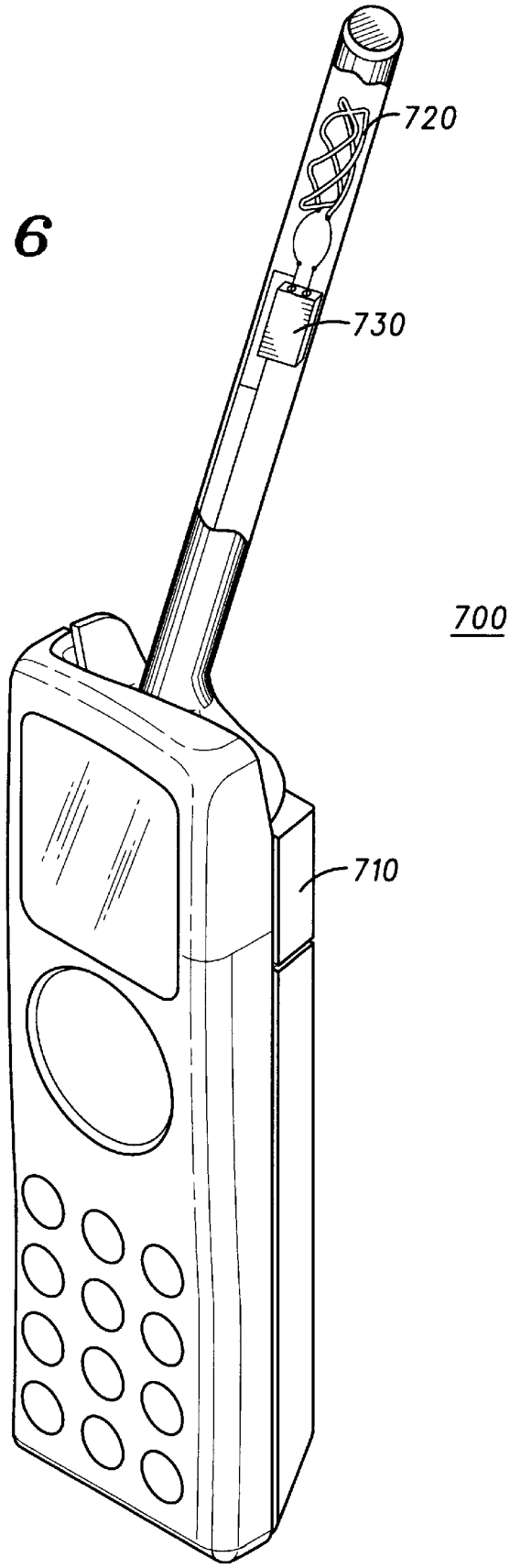
FIG. 6 illustrates a portable radiotelephone according to the present invention.

FIG. 6 illustrates a portable radiotelephone 700 having radio transceiver circuitry 710 coupled to a balanced antenna 720 via a balun 730. The balanced antenna 720 can be the illustrated quadrifilar helix antenna or a dipole.

Although the invention has been described and illustrated in the above description and drawing, it is understood that this description is by example only and that numerous changes and modifications can be made by those skilled in the art without departing from the true spirit and scope of the invention. The present invention is applicable to devices including radios for cellular, paging, satellite and land mobile products. More flexible provision of integrated circuit chips in these and other devices is also achieved.

What is claimed is:

1. A balun network, comprising a first conductor portion having a first end and a second end, wherein the first conductor portion is formed by a first elongated metallic strip on a first dielectric surface;

a second conductor portion having a first end and a second end, wherein the second conductor portion is formed by a second elongated metallic strip on a second dielectric surface parallel to the first dielectric surface and separated from the first dielectric surface by at least one type of dielectric material, and wherein the first conductor portion and the second conductor portion are spaced a distance that provides for electromagnetic coupling therebetween;

a connecting conductor portion operatively coupling the second end of the first conductor portion to the second end of the second conductor portion, wherein the connecting conductor comprises a conductor interconnect coupling between the second ends of the first and second elongate metallic strips;

a balanced port formed by the first end of the first conductor portion and the first end of the second conductor portion; and an unbalanced port formed by a ground reference plane and the first end of the first conductor portion.

2. A balun network according to claim 1, wherein the ground plane is electromagnetically isolated from the first conductor portion and the second conductor portion.

3. A balun network according to claim 2, wherein the first conductor portion and the second conductor portion are the same length.

4. A balun network according to claim 1, wherein the first and second conductor portions have the same length.

5. A balun network according to claim 4, wherein said length is an odd integral multiple of about one-quarter of a wavelength of a frequency of interest.

6. A balun network according to claim 1, wherein the first conductor portion occupies a first plane and the second conductor portion occupies a second plane parallel to the first plane.

7. A balun network according to claim 1, wherein the first and second conductor portions are parallel.

8. A balun network according to claim 1, wherein the first and second conductor portions have the same cross-section.

9. A balun network according to claim 7, wherein the first conductor portion is curved in a switchback shape.

10. A balun network according to claim 1, the first conductor portion has an impedance different from an impedance of the second conductor portion.

11. A balun network according to claim 1, wherein the ground reference plane consists of a feed line ground conductor.

12. A balun network according to claim 1, wherein the ground reference plane comprises a feed line ground conductor and a plane adjacent to both of the first and second conductor portions.

13. A balun network according to claim 1, wherein the spacing between the first conductor portion and the second conductor portion are sufficient to provide a predetermined fractional bandwidth of the balun and wherein lengths of the first and second conductor portions are sufficient to provide a predetermined nominal frequency of the balun.

14. A balun network according to claim 1, wherein the length of the first conductor portion and the second conductor portion is based on a frequency of interest.

15. A balun network according to claim 14, wherein the first and second conductor portions have the same length, said same length being an odd integral multiple of about one-quarter of a wavelength of a nominal frequency of interest.

16. A balun network, comprising a dielectric block having a first metalized elongated hole and a second metalized elongated hole a first conductor portion formed by the first metalized elongated hole and having a first end and a second end;

a second conductor portion formed by the second metalized elongated hole and having a first end and a second end, wherein the first conductor portion and the second conductor portion are spaced a distance that provides for electromagnetic coupling therebetween;

a connecting conductor portion formed on the dielectric block by metalization on one surface coupling between the elongated holes and operatively coupling the second end of the first conductor portion to the second end of the second conductor portion;

a balanced port formed by the first end of the first conductor portion and the first end of the second conductor portion; and an unbalanced port formed by a ground reference plane and the first end of the first conductor portion.

17. A balun network according to claim 1, wherein the first and second conductor portions are formed by first and second elongated metallic strips on the same dielectric surface in the same plane.

18. A portable radio, comprising:

radio transceiver circuitry for providing an unbalanced output;

a balun comprising a first conductor portion having a first end and a second end, wherein the first conductor portion is formed by a first elongated metallic strip on a first dielectric surface, a second conductor portion having a first end and a second end, wherein the second conductor portion is formed by a second elongated metallic strip on a second dielectric surface parallel to the first dielectric surface and separated from the first dielectric surface by at least one type of dielectric material, and wherein the first conductor portion and the second conductor portion are spaced a distance that provides for electromagnetic coupling therebetween, a connecting conductor portion operatively coupling the second end of the first conductor portion to the second end of the second conductor portion, wherein the connecting conductor comprises a conductor interconnect coupling between the second ends of the first and second elongate metallic strips, and a ground reference plane electromagnetically isolated from the first and second conductor portions and wherein the unbalanced output of the radio transceiver is operatively coupled between ground reference plane and one of the first end of first conductor portion and first end of the second conductor portion; and an antenna element including a balanced antenna port, one conductor of the balanced antenna port of the antenna element connected to the first end of the first conductor portion and wherein another conductor of the balanced port of the antenna element is connected to the first end of the second conductor portion.

* * * * *